US007609105B2

(12) United States Patent
Chiang et al.

(10) Patent No.: US 7,609,105 B2
(45) Date of Patent: Oct. 27, 2009

(54) VOLTAGE LEVEL GENERATING DEVICE

(75) Inventors: Wei-Shan Chiang, Tai-Chung (TW); Ming-Huang Liu, Taipei Hsien (TW); Wei-Yang Ou, Kao-Hsiung (TW); Chen-Hsien Han, Hsinchu (TW); Meng-Yong Lin, Hsinchu (TW)

(73) Assignee: ILI Technology Corp., Jhubei, Hsinchu County (TW)

( * ) Notice: Subject to any disclaimer, the term of this patent is extended or adjusted under 35 U.S.C. 154(b) by 56 days.

(21) Appl. No.: 12/099,767

(22) Filed: Apr. 8, 2008

(65) Prior Publication Data

US 2009/0121783 A1 May 14, 2009

(30) Foreign Application Priority Data

Nov. 13, 2007 (TW) ..... 96142856 A

(51) Int. Cl.
*G05F 1/10* (2006.01)

(52) U.S. Cl. ..... 327/538; 327/407

(58) Field of Classification Search ..... 327/403, 327/407, 535, 538, 540
See application file for complete search history.

(56) References Cited

U.S. PATENT DOCUMENTS

| | | | | |
|---|---|---|---|---|
| 4,769,639 | A * | 9/1988 | Kawamura et al. | 345/95 |
| 5,798,741 | A * | 8/1998 | Kajihara | 345/94 |
| 7,202,880 | B2 * | 4/2007 | Takahashi | 345/690 |
| 7,375,725 | B2 * | 5/2008 | Sato et al. | 345/204 |
| 7,385,581 | B2 * | 6/2008 | Kojima et al. | 345/96 |
| 7,420,552 | B2 * | 9/2008 | Kushima et al. | 345/211 |
| 7,528,826 | B2 * | 5/2009 | Lee et al. | 345/204 |

* cited by examiner

*Primary Examiner*—Jeffrey S Zweizig
(74) *Attorney, Agent, or Firm*—Winston Hsu

(57) ABSTRACT

The present invention discloses a voltage level generating device. The voltage level generating device includes: a reference voltage generating module, a first circuit module, a second circuit module, and a switch module. The voltage level generating device disclosed in the present invention only requires a buffer, a voltage regulator, and a arithmetic logic unit (ALU) to attain the same function of the conventional common voltage level generating device, and thus the circuit layout area can be reduced so as to decrease the cost of the integrated circuit (IC). In addition, the voltage level generating device disclosed in the present invention also can select different output of voltage level in order to reduce the power consumption of a display device.

17 Claims, 7 Drawing Sheets

VOLTAGE LEVEL GENERATING DEVICE

BACKGROUND OF THE INVENTION

1. Field of the Invention

The present invention relates to a voltage level generating device, and more particularly, to a common voltage level generating device which can reduce the circuit layout area in a driver integrated circuit (IC) of a display device, and can select different output of voltage level in order to reduce the power consumption of the display device.

2. Description of the Prior Art

Please refer to FIG. 1. FIG. 1 shows a simplified circuit diagram of a conventional common voltage level generating device 100 utilized in a driver integrated circuit (IC) of a display device (not shown) in accordance with a prior art. As shown in FIG. 1, when the conventional common voltage level generating device 100 is required to output a common voltage level VCOM, the conventional common voltage level generating device 100 uses a digital-to-analog converter (DAC) 110 to generate a first reference voltage level VREFH, and then generate a first voltage level VCOMH via a first buffer 120, wherein the first voltage level VCOMH will be between a first specific voltage level DDVDH and a ground voltage level AGND. In addition, the conventional common voltage level generating device 100 uses the DAC 110 to generate a second reference voltage level VREFL, and then generate a second voltage level VCOML via the first reference voltage level VREFH, resistor units R1, R2 R3, and R4, an operational amplifier 130, and a second buffer 140, wherein the second voltage level VCOML will be between a second specific voltage level VCI and a third specific voltage level VCL.

In the conventional common voltage level generating device 100, the resistor units R1, R2 R3, and R4 having high resistance value are required in order to reduce static current consumption. In addition, the conventional common voltage level generating device 100 has to use at least two buffers and an operational amplifier, and thus the conventional common voltage level generating device 100 has a disadvantage of requiring large circuit layout area.

SUMMARY OF THE INVENTION

It is therefore one of the objectives of the present invention to provide a common voltage level generating device which can reduce the circuit layout area in a driver integrated circuit (IC) of a display device, and can select different output of voltage level in order to reduce the power consumption of the display device, so as to solve the above problem.

In accordance with an embodiment of the present invention, a voltage level generating device is disclosed. The voltage level generating device includes: a reference voltage generating module, a first circuit module, a second circuit module, and a switch module. The reference voltage generating module is utilized for providing a first reference voltage level and a second reference voltage level. The first circuit module has a first input terminal coupled to the reference voltage generating module for receiving the first reference voltage level, a second input terminal, and an output terminal coupled to the second input terminal, and the first circuit module is utilized for generating a first voltage level at the output terminal according to the first reference voltage level. The second circuit module has a first input terminal coupled to the reference voltage generating module for receiving the second reference voltage level, a second input terminal coupled to the second input terminal of the first circuit module, and an output terminal coupled to the second input terminal of the second circuit module, and the second circuit module is utilized for generating a second voltage level at the output terminal of the second circuit module according to the second reference voltage level. The switch module includes a first switch element coupled to the output terminal of the first circuit module and a second switch element coupled to the output terminal of the second circuit module, and the switch module is utilized for selectively outputting the first voltage level or the second voltage level.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the following description and the claims to refer to particular system components. As one skilled in the art will appreciate, manufacturers may refer to a component by different names. This document does not intend to distinguish between components that differ in name but not function. In the following discussion and in the claims, the terms "include", "including", "comprise", and "comprising" are used in an open-ended fashion, and thus should be interpreted to mean "including, but not limited to . . . " The terms "couple" and "coupled" are intended to mean either an indirect or a direct electrical connection. Thus, if a first device couples to a second device, that connection may be through a direct electrical connection, or through an indirect electrical connection via other devices and connections.

The present invention relates to a voltage level generating device that can be implemented in an integrated circuit (IC). This document will illustrate several exemplary embodiments that apply the voltage level generating device in the present invention. A person of average skill in the pertinent art should, however, be able to understand that the voltage level generating device of the present invention also can be applied to other similar types of ICs and is not limited to the particular embodiments described in the following paragraphs or to the particular manner in which any features of such embodiments are implemented.

In general, the voltage level generating device of the present invention can be applied to all kinds of ICs. By way of example but not limitation, a common voltage level generating device applied to a driver IC of a display device is disclosed in accordance with the present invention. In addition, under a condition of not affecting the technical disclosure of the present invention, the driver IC of the display device will be used as an example to illustrate the details of the circuit configuration and the operational scheme of the voltage level generating device in the present invention.

Figure 1:
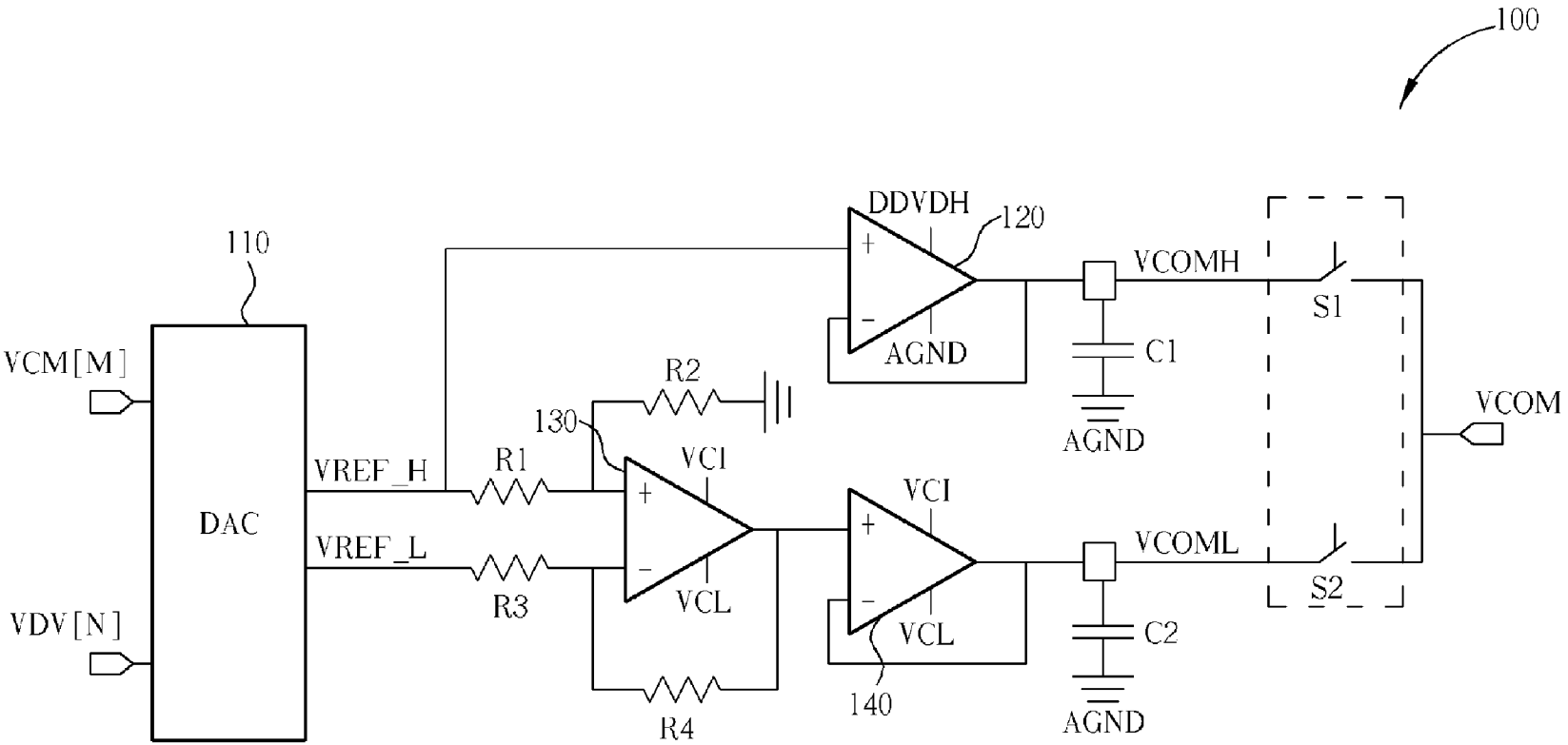
FIG. 1 PRIOR ART
FIG. 1 shows a simplified circuit diagram of a conventional common voltage level generating device utilized in a driver integrated circuit (IC) of a display device in accordance with a prior art.
Figure 2:
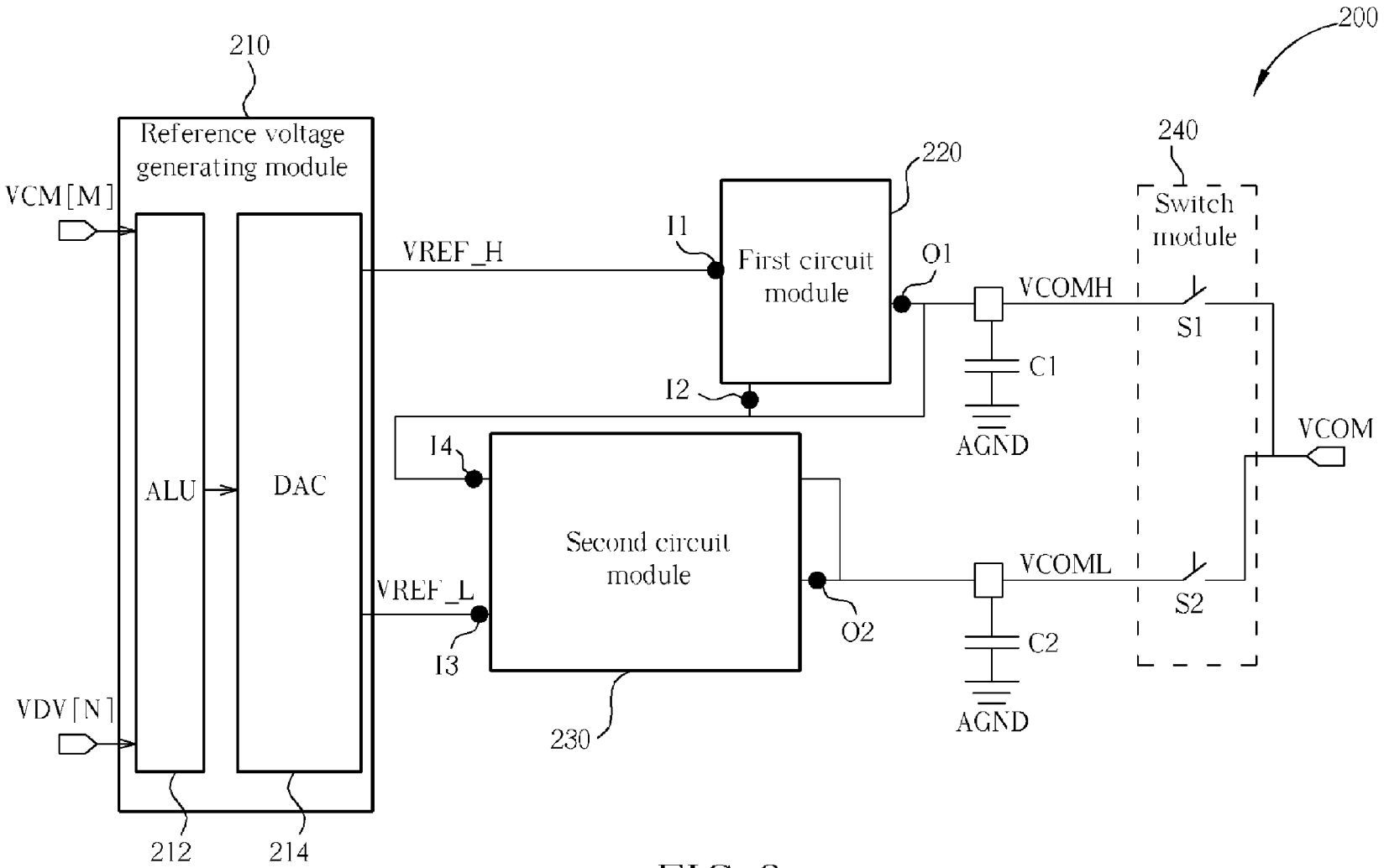
FIG. 2 shows a simplified block diagram of a voltage level generating device in accordance with a first embodiment of the present invention.

Please refer to FIG. 2. FIG. 2 shows a simplified block diagram of a voltage level generating device 200 in accordance with a first embodiment of the present invention. As shown in FIG. 2, the voltage level generating device 200 includes: a reference voltage generating module 210, a first circuit module 220, a second circuit module 230, a switch module 240, a first capacitor unit C1, and a second capacitor unit C2. The reference voltage generating module 210 is utilized for providing a first reference voltage level VREFH and a second reference voltage level VREFL. The first circuit module 220 has a first input terminal I1 coupled to the reference voltage generating module 210 for receiving the first reference voltage level VREFH, a second input terminal, and an output terminal O1 coupled to the second input terminal I2, and the first circuit module 220 is utilized for generating a first voltage level VCOMH at the output terminal O1 according to the first reference voltage level VREFH. The second circuit module 230 has a first input terminal I3 coupled to the reference voltage generating module 210 for receiving the second reference voltage level VREFL, a second input terminal I4 coupled to the second input terminal I2 of the first circuit module 220, and an output terminal O2 coupled to the second input terminal I2 of the second circuit module 230, and the second circuit module 230 is utilized for generating a second voltage level VCOML at the output terminal O1 of the second circuit module 230 according to the second reference voltage level VREFL. The switch module 240 includes a first switch element S1 coupled to the output terminal O1 of the first circuit module 220 and a second switch element S2 coupled to the output terminal O1 of the second circuit module 230, and the switch module 240 is utilized for selectively outputting the first voltage level VCOMH or the second voltage level VCOML as an output of a common voltage level VCOM. In addition, the first capacitor unit C1 is coupled between the first voltage level VCOMH and a ground voltage level AGND, and the first capacitor unit C1 is utilized for steadying a voltage level of the output terminal O1 of the first circuit module 220. The second capacitor unit C2 is coupled between the second voltage level and the ground voltage level AGND, and the second capacitor unit C2 is utilized for steadying a voltage level of the output terminal O2 of the second circuit module 230. In addition, please note that the above embodiment is only for an illustrative purpose and is not meant to be a limitation of the present invention. For example, the first capacitor unit C1 and the second capacitor unit C2 are not essential elements in the voltage level generating device 200 of the present invention, and thus the first capacitor unit C1 and the second capacitor unit C2 can be ignored in specific conditions. Next, this document will illustrate details of the circuit configuration and the operational scheme of the voltage level generating device 200 in the present invention.

Figure 3:
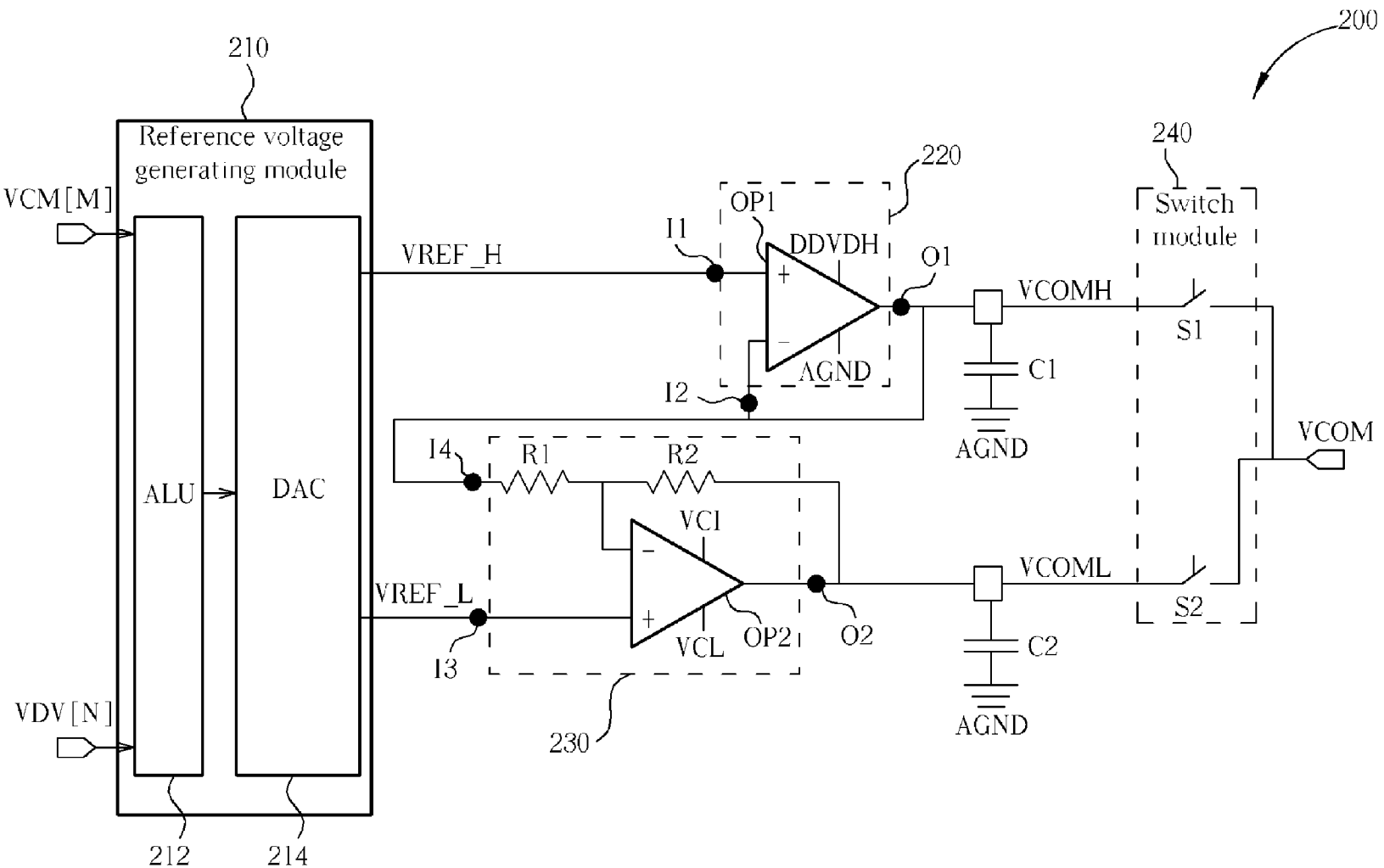
FIG. 3 shows a simplified circuit configuration diagram of the voltage level generating device shown in FIG. 2.

Please refer to FIG. 3. FIG. 3 shows a simplified circuit configuration diagram of the voltage level generating device 200 shown in FIG. 2. As shown in FIG. 3, the reference voltage generating module 210 includes a arithmetic logic unit (ALU) 212 and a digital-to-analog converter (DAC) 214. The ALU 212 is utilized for receiving a first digital signal VCM[M] and a second digital signal VDV[N], and processing the first digital signal VCM[M] and the second digital signal VDV[N] to generate a first digital output signal (not shown) and a second digital output signal (not shown). The DAC 214 is coupled to the ALU 212, and the DAC 214 is utilized for generating the first reference voltage level VREFH and the second reference voltage level VREFL according to the first digital output signal and the second digital output signal, respectively. In addition, the first circuit module 220 can be a buffer module, and the first circuit module 220 includes an operational amplifier OP1. The second circuit module 230 is a voltage regulating module, and the second circuit module 230 includes an operational amplifier OP2, a first resistor unit R1 coupled between the operational amplifier OP2 and the second input terminal I4 of the second circuit module 230, and a second resistor unit R2 coupled between the first resistor unit R1 and the output terminal O2. In addition, the switch module 240 includes a first switch element S1 coupled to the output terminal O1 of the first circuit module 220 and a second switch element S2 coupled to the output terminal O1 of the second circuit module 230, and the switch module 240 can selectively output the first voltage level VCOMH or the second voltage level VCOML as an output of a common voltage level VCOM via switching a turn-on state and a turn-off state of the first switch element S1 and the second switch element S2. In addition, the first capacitor unit C1 is coupled between the first voltage level VCOMH and a ground voltage level AGND, and the first capacitor unit C1 is utilized for steadying a voltage level of the output terminal O1 of the first circuit module 220. The second capacitor unit C2 is coupled between the second voltage level and the ground voltage level AGND, and the second capacitor unit C2 is utilized for steadying a voltage level of the output terminal O2 of the second circuit module 230.

Figure 4:
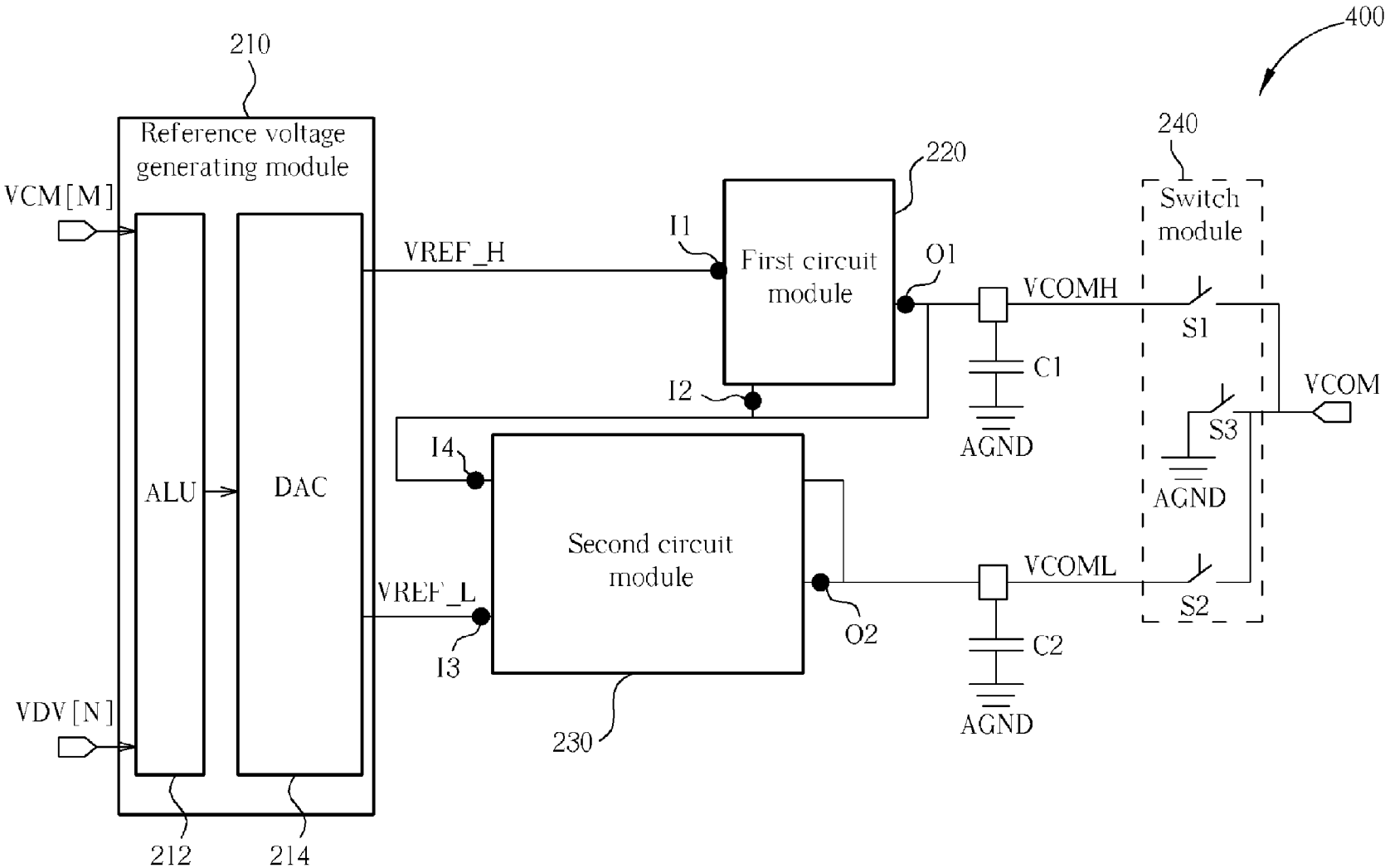
FIG. 4 shows a simplified block diagram of a voltage level generating device in accordance with a second embodiment of the present invention.

Please refer to FIG. 4. FIG. 4 shows a simplified block diagram of a voltage level generating device 400 in accordance with a second embodiment of the present invention. The voltage level generating device 400 is substantially the same as the voltage level generating device 200 in the first embodiment of the present invention, and includes: a reference voltage generating module 210, a first circuit module 220, a second circuit module 230, a switch module 240, a first capacitor unit C1, and a second capacitor unit C2. The voltage level generating device 400 in the second embodiment of the present invention and the voltage level generating device 200 in the first embodiment of the present invention have similar circuit configurations, and thus the element symbols of the voltage level generating device 400 in FIG. 4 are the same as the element symbols of the voltage level generating device 200 in FIG. 2. Therefore, further explanation of the details of the circuit configuration and the operational scheme of the voltage level generating device 400 is omitted herein for the sake of brevity. The difference between the voltage level generating device 400 and the voltage level generating device 200 in FIG. 2 is shown in FIG. 4. The switch module 240 further includes a third switch element S3. The third switch element S3 is coupled to the ground voltage level AGND, and the switch module 240 can selectively output the ground voltage level AGND to replace the second voltage level VCOML as an output of a common voltage level VCOM via switching a turn-on state and a turn-off state of the third switch element S3. In addition, please note that the above embodiment is only for an illustrative purpose and is not meant to be a limitation of the present invention. For example, the ground voltage level AGND also can be replaced by a fixed voltage level which is between the first voltage level VCOMH and the second voltage level VCOML in accordance with different circuit design requirements.

Figure 5:
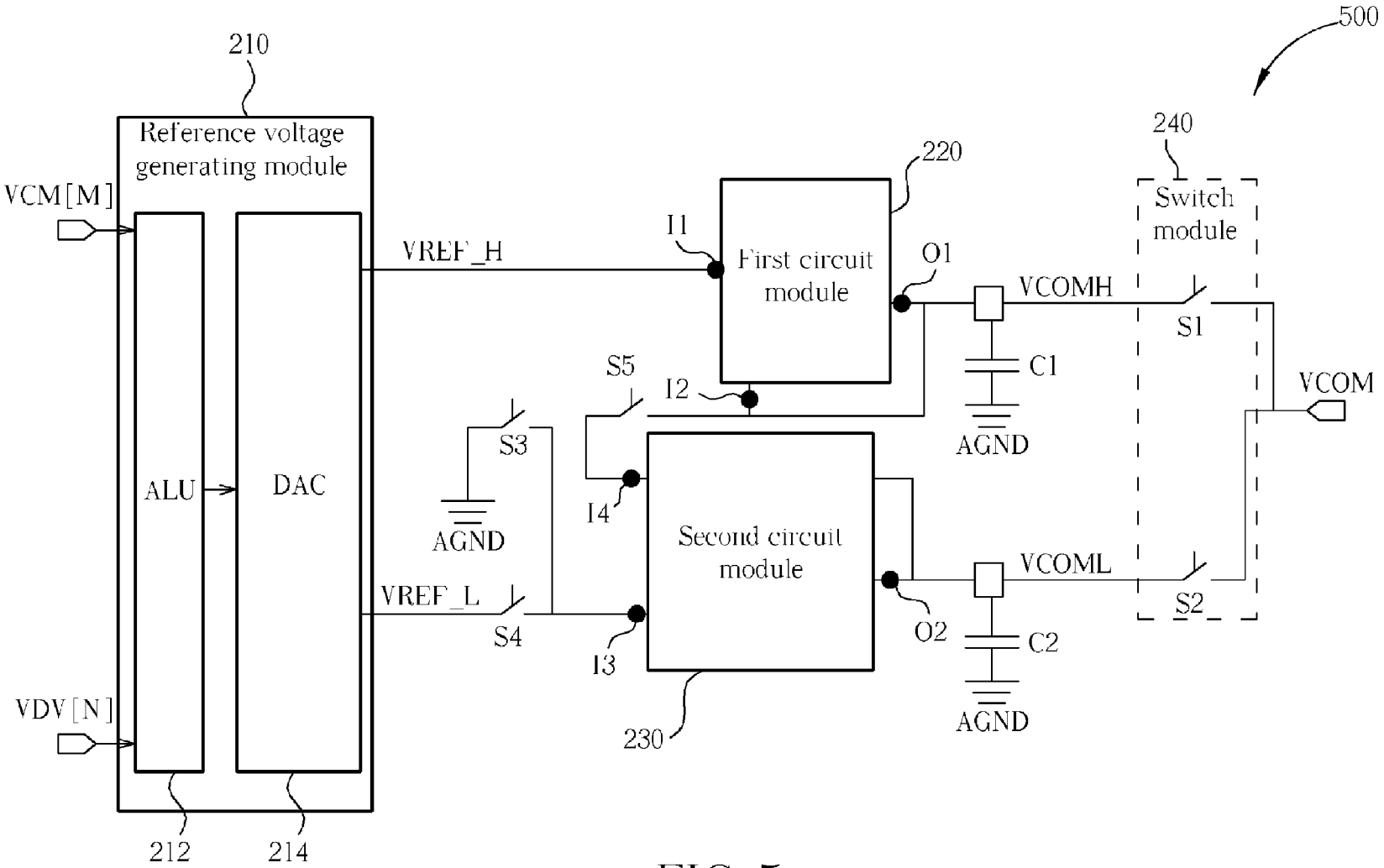
FIG. 5 shows a simplified block diagram of a voltage level generating device in accordance with a third embodiment of the present invention.

Please refer to FIG. 5. FIG. 5 shows a simplified block diagram of a voltage level generating device 500 in accordance with a third embodiment of the present invention. Like the voltage level generating device 200 in the first embodiment of the present invention, the voltage level generating device 500 also includes: a reference voltage generating module 210, a first circuit module 220, a second circuit module 230, a switch module 240, a first capacitor unit C1, and a second capacitor unit C2. The voltage level generating device 500 in the third embodiment of the present invention and the voltage level generating device 200 in the first embodiment of the present invention have similar circuit configurations, and thus the element symbols of the voltage level generating device 500 in FIG. 5 are the same as the element symbols of the voltage level generating device 200 in FIG. 2. Therefore, further explanation of the details of the circuit configuration and the operational scheme of the voltage level generating device 500 is omitted herein for the sake of brevity. The difference between the voltage level generating device 500 and the voltage level generating device 200 in FIG. 2 is shown in FIG. 5. The voltage level generating device 500 further includes a third switch element S3, a fourth switch element S4, and a fifth switch element S5. The third switch element S3 is coupled to a ground voltage level AGND and the first input terminal I3 of the second circuit module 230, and the fourth switch element S4 is coupled between the reference voltage generating module 210 and the first input terminal I3 of the second circuit module 230. The fifth switch element S5 is coupled between the second input terminal I4 of the second circuit module 230 and the second input terminal I2 of the first circuit module 220. When the voltage level generating device 500 is required to output the ground voltage level AGND to replace the second voltage level VCOML as an output of a common voltage level VCOM, the third switch element S3 and the second switch element S2 are in a turn-on state, and the fourth switch element S4, the fifth switch element S5, and the first switch element S1 are in a turn-off state. In addition, the first capacitor unit C1 is coupled between the first voltage level VCOMH and a ground voltage level AGND, and the first capacitor unit C1 is utilized for steadying a voltage level of the output terminal O1 of the first circuit module 220. The second capacitor unit C2 is coupled between the second voltage level VCOML and a third voltage level VCI, and the second capacitor unit C2 is utilized for steadying a voltage level of the output terminal O2 of the second circuit module 230, wherein the third voltage level VCI is higher than the ground voltage level AGND. Similarly, please note that the above embodiment is only for an illustrative purpose and is not meant to be a limitation of the present invention. For example, the ground voltage level AGND also can be replaced by a fixed voltage level which is between the first voltage level VCOMH and the second voltage level VCOML, in accordance with different circuit design requirements.

Figure 6:
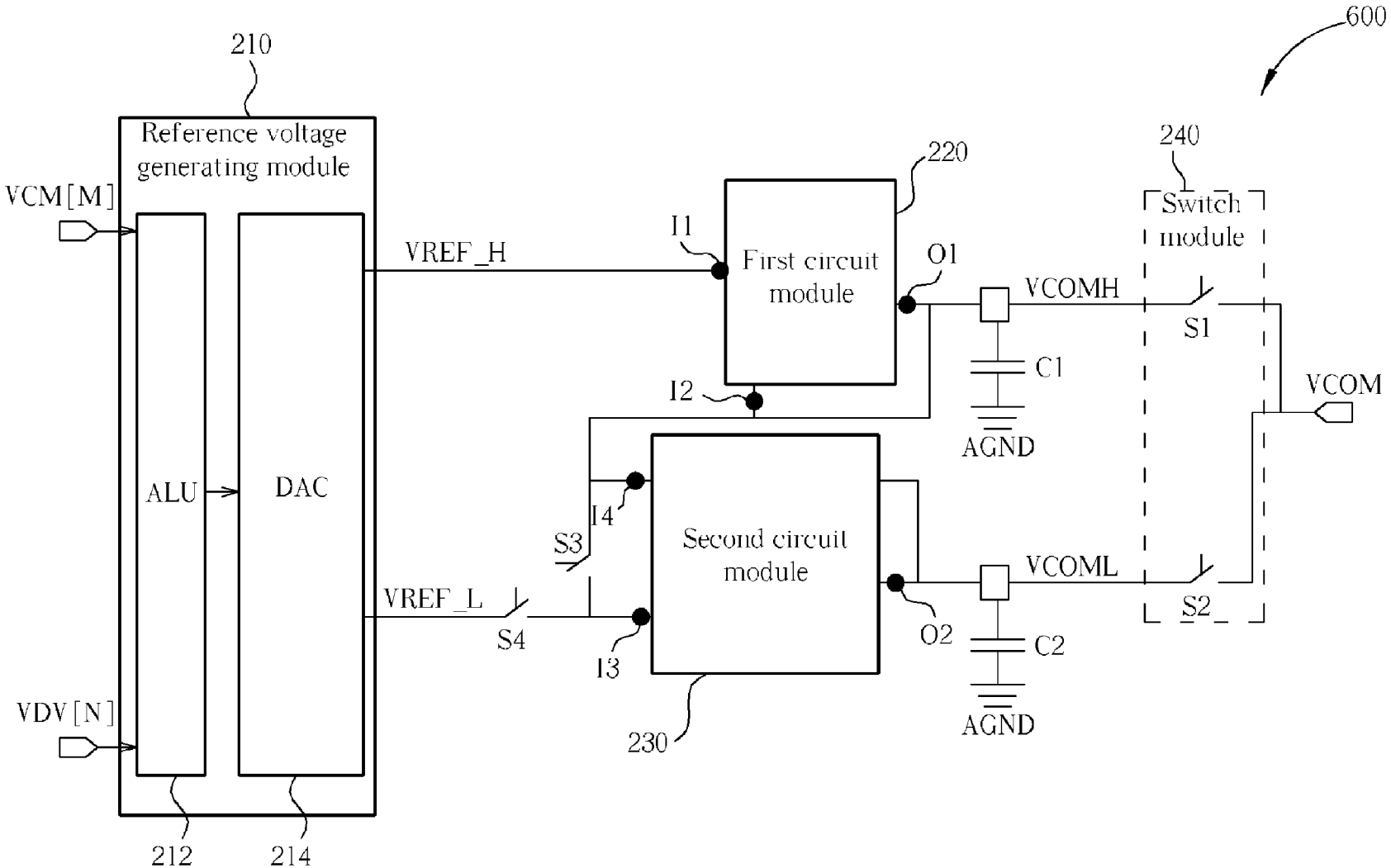
FIG. 6 shows a simplified block diagram of a voltage level generating device in accordance with a fourth embodiment of the present invention.

Please refer to FIG. 6. FIG. 6 shows a simplified block diagram of a voltage level generating device 600 in accordance with a fourth embodiment of the present invention. Like the voltage level generating device 200 in the first embodiment of the present invention, the voltage level generating device 600 also includes: a reference voltage generating module 210, a first circuit module 220, a second circuit module 230, a switch module 240, a first capacitor unit C1, and a second capacitor unit C2. The voltage level generating device 600 in the fourth embodiment of the present invention and the voltage level generating device 200 in the first embodiment of the present invention have similar circuit configurations, and thus the element symbols of the voltage level generating device 600 in FIG. 6 are the same as the element symbols of the voltage level generating device 200 in FIG. 2. Therefore, further explanation of the details of the circuit configuration and the operational scheme of the voltage level generating device 600 is omitted herein for the sake of brevity. The difference between the voltage level generating device 600 and the voltage level generating device 200 in FIG. 2 is shown in FIG. 6. The voltage level generating device 600 further includes a third switch element S3 and a fourth switch element S4. The third switch element S3 is coupled between the first input terminal I3 and the second input terminal I4 of the second circuit module 230, and the fourth switch element S4 is coupled between the reference voltage generating module 210 and the first input terminal I3 of the second circuit module 230, wherein when the voltage level generating device 600 is required to output the ground voltage level AGND to replace the second voltage level VCOML as an output of a common voltage level VCOM, the third switch element S3 and the second switch element S2 are in a turn-on state, and the fourth switch element S4 and the first switch element S1 are in a turn-off state. Similarly, please note that the above embodiment is only for an illustrative purpose and is not meant to be a limitation of the present invention.

Figure 7:
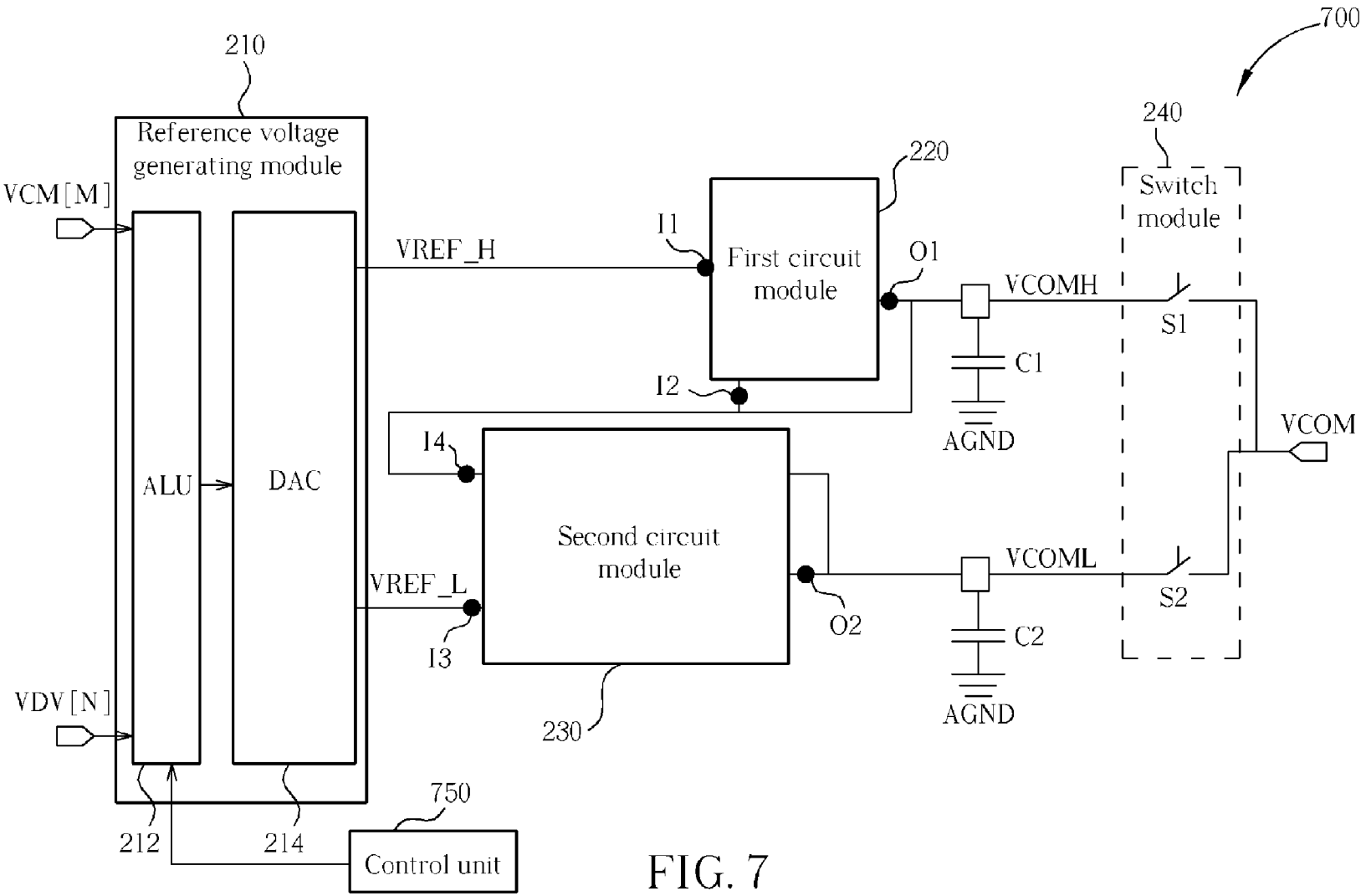
FIG. 7 shows a simplified block diagram of a voltage level generating device in accordance with a fifth embodiment of the present invention.

Please refer to FIG. 7. FIG. 7 shows a simplified block diagram of a voltage level generating device 700 in accordance with a fifth embodiment of the present invention. Like the voltage level generating device 200 in the first embodiment of the present invention, the voltage level generating device 700 also includes: a reference voltage generating module 210, a first circuit module 220, a second circuit module 230, a switch module 240, a first capacitor unit C1, and a second capacitor unit C2. The voltage level generating device 700 in the fifth embodiment of the present invention and the voltage level generating device 200 in the first embodiment of the present invention have similar circuit configurations, and thus the element symbols of the voltage level generating device 700 in FIG. 7 are the same as the element symbols of the voltage level generating device 200 in FIG. 2. Therefore, further explanation of the details of the circuit configuration and the operational scheme of the voltage level generating device 700 are omitted herein for the sake of brevity. The difference between the voltage level generating device 700 and the voltage level generating device 200 in FIG. 2 is shown in FIG. 7. The voltage level generating device 700 further includes a control unit 750. The control unit 750 is coupled to the ALU 212, and utilized for controlling the ALU 212 to selectively process the second digital signal VDV[N] to generate a third digital output signal (not shown), so as to let the DAC 214 generate the second reference voltage level VREFL according to the third digital output signal and let the second circuit module 230 generate a ground voltage level AGND at the output terminal O2 of the second circuit module 230 according to the second reference voltage level VREFL to replace the second voltage level VCOML as an output of a common voltage level VCOM. Similarly, please note that the above embodiment is only for an illustrative purpose and is not meant to be a limitation of the present invention.

Briefly summarized, the voltage level generating device disclosed in the present invention only requires a buffer, a voltage regulator, and an ALU to attain the same function of the conventional common voltage level generating device, and thus the circuit layout area can be reduced so as to decrease the cost of the IC. In addition, the voltage level generating device disclosed in the present invention also can select different output of voltage level in order to reduce the power consumption of a display device.

Those skilled in the art will readily observe that numerous modifications and alterations of the device and method may be made while retaining the teachings of the invention.

What is claimed is:

1. A voltage level generating device, comprising:

a reference voltage generating module, for providing a first reference voltage level and a second reference voltage level;

a first circuit module, having a first input terminal coupled to the reference voltage generating module for receiving the first reference voltage level, a second input terminal, and an output terminal coupled to the second input terminal, the first circuit module being utilized for generating a first voltage level at the output terminal according to the first reference voltage level;

a second circuit module, having a first input terminal coupled to the reference voltage generating module for receiving the second reference voltage level, a second input terminal coupled to the second input terminal of the first circuit module, and an output terminal coupled to the second input terminal of the second circuit module, the second circuit module being utilized for generating a second voltage level at the output terminal of the second circuit module according to the second reference voltage level; and a switch module, comprising a first switch element coupled to the output terminal of the first circuit module and a second switch element coupled to the output terminal of the second circuit module, for selectively outputting the first voltage level or the second voltage level.

2. The voltage level generating device of claim 1, wherein the first circuit module is a buffer module.

3. The voltage level generating device of claim 1, wherein the first circuit module comprises an operational amplifier.

4. The voltage level generating device of claim 1, wherein the second circuit module is a voltage regulating module.

5. The voltage level generating device of claim 4, wherein the second circuit module comprises an operational amplifier, a first resistor unit coupled between the operational amplifier and the second input terminal of the second circuit module, and a second resistor unit coupled between the first resistor unit and the output terminal.

6. The voltage level generating device of claim 1, wherein the switch module further comprises:

a third switch element, coupled to a fixed voltage level, for selectively outputting the fixed voltage level to replace the second voltage level, wherein the fixed voltage level is between the first voltage level and the second voltage level.

7. The voltage level generating device of claim 6, wherein the fixed voltage level is a ground voltage level.

8. The voltage level generating device of claim 7, further comprising:

a first capacitor unit, coupled between the first voltage level and the ground voltage level, for steadying a voltage level of the output terminal of the first circuit module; and a second capacitor unit, coupled between the second voltage level and the ground voltage level, for steadying a voltage level of the output terminal of the second circuit module.

9. The voltage level generating device of claim 1, further comprising:

a third switch element, coupled to a fixed voltage level and the first input terminal of the second circuit module, wherein the fixed voltage level is between the first voltage level and the second voltage level;

a fourth switch element, coupled between the reference voltage generating module and the first input terminal of the second circuit module; and a fifth switch element, coupled between the second input terminal of the second circuit module and the second input terminal of the first circuit module;

wherein when the voltage level generating device is required to output the fixed voltage level to replace the second voltage level, the third switch element and the second switch element are in a turn-on state, and the fourth switch element, the fifth switch element, and the first switch element are in a turn-off state.

10. The voltage level generating device of claim 9, wherein the fixed voltage level is a ground voltage level or an arbitrary voltage level between the first voltage level and the second voltage level.

11. The voltage level generating device of claim 10, further comprising:

a first capacitor unit, coupled between the first voltage level and the ground voltage level, for steadying a voltage level of the output terminal of the first circuit module; and a second capacitor unit, coupled between the second voltage level and a third voltage level, for steadying a voltage level of the output terminal of the second circuit module, wherein the third voltage level is higher than the ground voltage level.

12. The voltage level generating device of claim 1, further comprising:

a third switch element, coupled to the first input terminal and the second input terminal of the second circuit module; and a fourth switch element, coupled between the reference voltage generating module and the first input terminal of the second circuit module;

wherein when the voltage level generating device is required to output a ground voltage level to replace the second voltage level, the third switch element and the second switch element are in a turn-on state, and the fourth switch element and the first switch element are in a turn-off state.

13. The voltage level generating device of claim 12, further comprising:

a first capacitor unit, coupled between the first voltage level and the ground voltage level, for steadying a voltage level of the output terminal of the first circuit module; and a second capacitor unit, coupled between the second voltage level and a third voltage level, for steadying a voltage level of the output terminal of the second circuit module, wherein the third voltage level is higher than the ground voltage level.

14. The voltage level generating device of claim 1, wherein the reference voltage generating module comprises:

an arithmetic logic unit (ALU), for receiving at least a first digital signal and at least a second digital signal, and processing the first digital signal and the second digital signal to generate a first digital output signal and a second digital output signal; and a digital-to-analog converter (DAC), coupled to the ALU, for generating the first reference voltage level and the second reference voltage level according to the first digital output signal and the second digital output signal, respectively.

15. The voltage level generating device of claim 14, further comprising:

a control unit, coupled to the ALU, for controlling the ALU to selectively process the second digital signal to generate a third digital output signal, wherein the DAC generates the second reference voltage level according to the third digital output signal, to let the second circuit module generate a ground voltage level at the output terminal of the second circuit module according to the second reference voltage level.

16. The voltage level generating device of claim 15, further comprising:

a first capacitor unit, coupled between the first voltage level and the ground voltage level, for steadying a voltage level of the output terminal of the first circuit module; and a second capacitor unit, coupled between the second voltage level and a third voltage level, for steadying a voltage level of the output terminal of the second circuit module, wherein the third voltage level is higher than the ground voltage level.

17. The voltage level generating device of claim 1, being a common voltage level generating device utilized in a driver integrated circuit (IC) of a display device.

* * * * *